United States Patent [19]

Jaquay

[11] 4,094,667

[45] June 13, 1978

[54] MELTING OF FINE PARTICULATE MATERIAL IN A HIGH-SPEED ROTARY FURNACE

[75] Inventor: Louis H. Jaquay, Pittsburgh, Pa.

[73] Assignee: Dravo Corporation, Pittsburgh, Pa.

[21] Appl. No.: 764,083

[22] Filed: Jan. 31, 1977

[51] Int. Cl.[2] ..... C22B 5/02

[52] U.S. Cl. ..... 75/92; 75/43; 75/65 R

[58] Field of Search ..... 75/33, 38, 92, 43, 65

[56] References Cited

U.S. PATENT DOCUMENTS 3,514,280 5/1970 Sherwood ..... 75/38

*Primary Examiner*—P. D. Rosenberg

*Attorney, Agent, or Firm*—Parmelee, Miller, Welsh & Kratz

[57] ABSTRACT

Finely divided particulate material is discharged against the incandescent wall of a rotary furnace through a pipe extending into the open end of the furnace in a position where the material is out of the path of the flame projected into the furnace through the open end and out of the path of the outflowing gases. The material is retained against the interior wall of the furnace by centrifugal force and, as the material melts, it collects in a pool at the inner end of the furnace. The entrainment of fine particles and their subsequent removal with the exhaust furnace gases is thereby substantially reduced, if not entirely eliminated.

5 Claims, 2 Drawing Figures

2
3
4
5
6
7
8
9
10
11
II
II 2
7
10
11
Direction of Rotation

MELTING OF FINE PARTICULATE MATERIAL IN A HIGH-SPEED ROTARY FURNACE

This invention relates to the melting of finely divided particulate materials, especially metallic ores and minerals in a direct-fired furnace while avoiding any substantial carry-out of the finely divided material as flue dust in the outflowing furnace gases. The invention is for a method of and apparatus for the conversion of finely divided particulate material into a molten liquid wherein the particulate material may be, but not necessarily is, an ore which is also smelted as it is reduced to a liquid state.

The beneficiation of many metallic ores leaves the ore in a finely divided condition. If such finely divided material is introduced into a smelting furnace, a considerable part of it may be carried out of the furnace as dust in the effluent furnace gases. To avoid this loss of such ore in this way, it must first be agglomerated, as by sintering, pelletizing, or other procedures where individual particles are bonded into bodies of a convenient size for charging into a smelting furnace and thus be too large and heavy to be carried out of the furnace by the exhaust gases. Such agglomeration of the ore, of course, adds to the expense of the smelting operation and entails additional plant expense.

While this invention is especially useful in connection with the smelting of metal bearing ores, it may be useful in other operations where the introduction of finely divided batch material into a melting furnace is involved, as, for example, the manufacture of glass, glass fibers, frit and like products from finely divided batch materials.

This invention employs a familiar type of rotary furnace having a generally cylindrical chamber that is inclined upwardly toward its open end with a lance-type burner projected into said open end at an angle such that the flames impinge against the surface of a pool of molten material collected in the lower end of the furnace chamber, with the flames then being deflected upwardly and outwardly and in the reverse direction to discharge in the usual way from the said open upper end. The finely divided material to be melted is introduced into the furnace through a delivery pipe projecting into the open end of the furnace. It is blown or moved by gravity through the pipe in such manner as to be deposited in a generally continuous stream onto the incandescent lining of the furnace as the furnace is rotating. The discharge terminal of the pipe is located below and to one side of the axis of the fuel lance or burner near the forwardmost boundary of the pool of molten metal so that the material does not discharge directly into the pool but at some location between the entrance end of the furnace and that edge of the pool which is closest to the entrance end of the furnace, but not into the pool itself. In brief, the material to be melted is deposited on the lining of the furnace isolated from the high velocity gas stream resulting from the burning of fuel from the lance, both as such gases enter the furnace and as they leave. The furnace is rotated at a speed where the refractory lining is close to its critical speed and the material to be melted almost instantly acquires the speed of the refractory and is thereby held in place by centrifugal force adequate to prevent its dispersal by the gas stream while it quickly melts and flows into the molten pool within the furnace. Melting usually occurs in less than one revolution of the furnace.

The invention may be more fully understood by reference to the accompanying drawings, in which.

Figure 1:
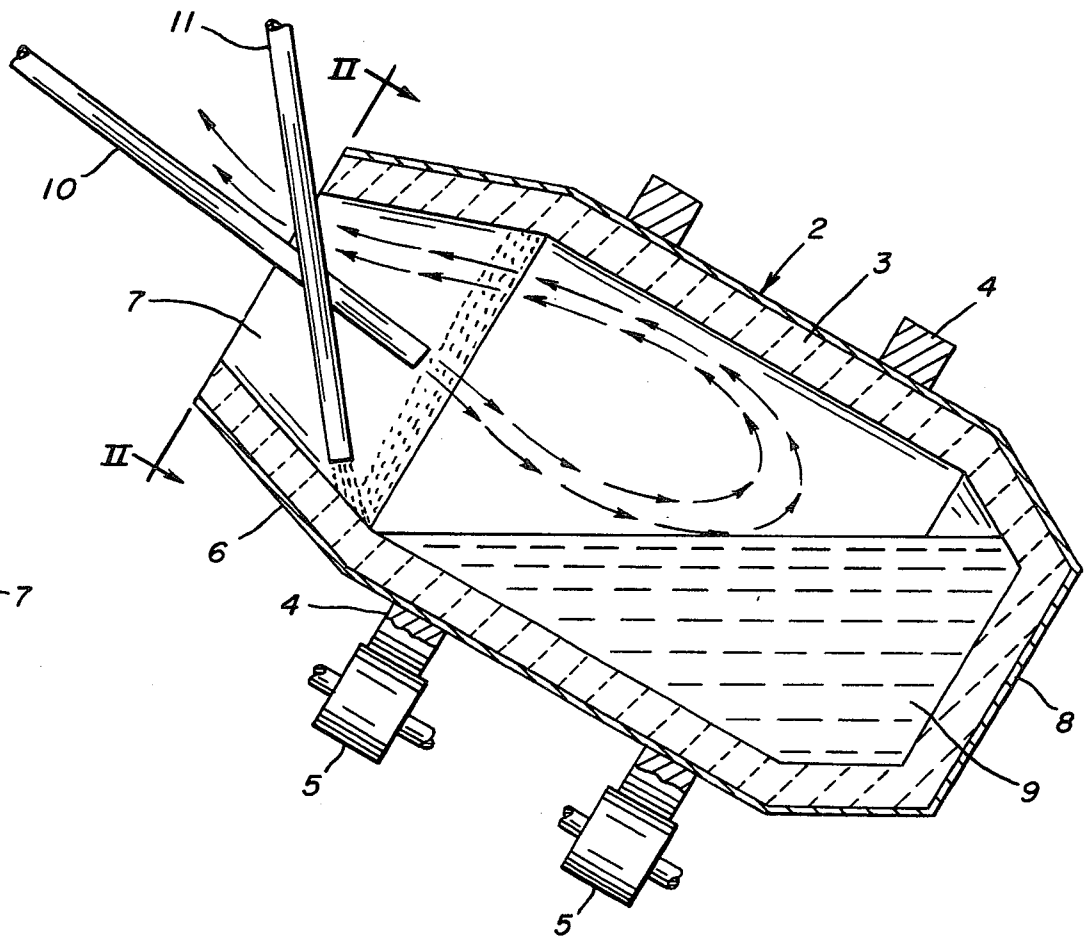
FIG. 1 is a schematic drawing representing generally a rotary furnace used in metallurgical processes, and especially in the refining of molten metal.

In the drawing, 2 designates generally the cylindrical outer metal shell of a rotary furnace with a refractory lining 3. Bearing rings 4 surround the shell and rest on rollers 5, at least some of which are power driven to rotate the furnace in a manner well understood in the art and forming no part, per se, of the present invention. The furnace is of the customary design with a forwardly tapering portion 6 terminating in a central opening 7. The opposite or rear end 8 of the furnace is closed.

The supporting rollers 5 are so arranged that the longitudinal axis of the shell is at an angle to the horizontal. Arranged in this way, a pool of molten metal of rearwardly increasing depth may be retained in the furnace, as indicated at 9, while the refractory lining forwardly of this pool is not submerged. A burner or fuel injection lance 10 is entered into the opening in the forward end of the furnace at an angle to project burning gases against the surface of the pool. As indicated in the drawings, these gases impinge the surface of the pool, swirl upwardly and then forwardly, the spent gases escaping through the opening 7. Furnaces of this type are commonly arranged to be tilted to discharge the molten metal by first withdrawing the lance and then tilting the furnace until the metal is poured out the open end, but since this is not material to the understanding of this invention, means for so tilting the furnace is not shown.

According to this invention, a material feed tube or lance 11 is entered into the open end of the furnace at a steeper angle than the burner lance, and the fine particulate ore is delivered through this lance, either by gravity or pressure and projected downwardly onto the surface of the refractory furnace lining at a place below and to one side of the burner lance terminal. The material, upon leaving the material lance, is deposited onto the furnace lining as the furnace is rotating and at a place forwardly of the pool 9 but inwardly of the opening 7. At this place, the material is out of the main stream of gases leaving the furnace as well as out of the path of the burning gases from the fuel lance. Moreover, the discharge end of the material lance is close to the inner surface of the furnace so that there is only a short free fall between the inner end of the material lance and the moving refractory wall onto which it falls.

Figure 2:
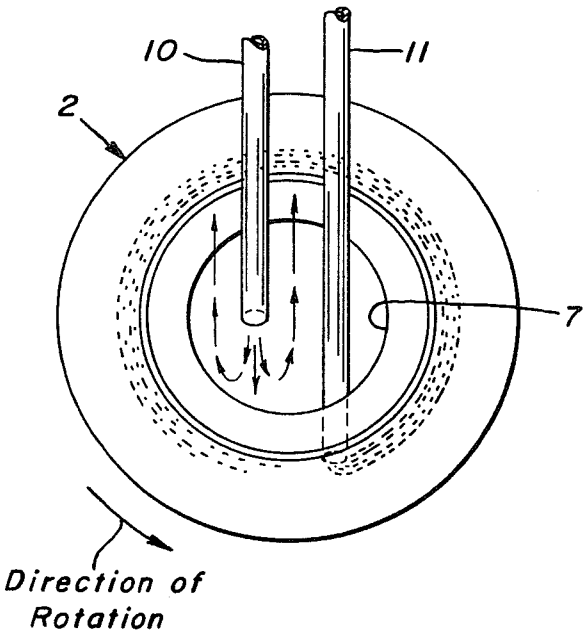
FIG. 2 is a transverse section in about the plane of line II—II of FIG. 1.

With the furnace rotating in the direction of the arrow in FIG. 2, the material which is deposited on the lining of the furnace is carried upward in a thin band or layer which is retained against the refractory lining by centrifugal force. Assuming that the interior of the furnace is ten feet in diameter, the critical speed at which centrifugal force is about equal to the weight of the particulate material is roughly about 24 RPM, which is a speed about equal to a velocity at the inside surface of the drum of about 760 feet per minute. The heat in the furnace is such that the layer of material deposited on the lining will generally melt in less than one complete revolution, and being held on the refractory lining by centrifugal force and being in the process of melting where the particles tend to cling together, the material will not be carried out by the spent gases leaving the furnace. As melting progresses, the fluid material will enter the pool and become a part of it, while a fresh layer of material is deposited with the next revolution of the furnace, the deposition of the particulate material and the melting of it taking place continuously until such time as the furnace needs to be tilted to discharge the accumulated melt. Slag may be produced with the melting of the ore particles and it will, of course, collect on the surface of the melt, but the interior walls of the furnace not covered by the melt will become highly heated and carry this heat with the rotation of the furnace into the molten pool beneath the slag.

Direct reduction of finely divided ores may thus be effected without appreciable removal of the ore particles with the furnace gases, making the preparation of the ore into agglomerates prior to smelting unnecessary.

While smelting of ores has been particularly described, other materials, such as glass batch materials and frit-forming materials and other heat fusible materials, may be reduced to a molten state in a similar manner.

I claim:

1. The method of melting finely divided particulate material in a rotary furnace with a refractory lining and with opposed ends, one of which is open, said furnace and lining being arranged to collect and retain a pool of molten metal during operation of the furnace of maximum depth near one end and diminishing depth extending toward said open end but terminating within the furnace between the place of maximum depth and before reaching said open end whereby there is an area of the refractory lining between the pool and the open end beyond which the said pool of molten metal extends and which is continuously exposed to the atmosphere within the furnace, the steps comprising:

(a) continuously depositing the particulate material from a feed pipe which enters the open end of the furnace onto the refractory lining at the furnace at the low point of revolution of the refractory lining which it is revolving and between the pool of molten metal and said open end;

(b) projecting burning gases within the furnace from burner means at the open end of the furnace at a level above the place of discharge of the particulate material onto the refractory wall and said place of discharge being out of the direct path of the outflow of said gases through the open end of said furnace wall; and (c) retaining the particulate material on the refractory lining of the furnace by centrifugal force until the material is melted, and collecting the melted material in said pool.

2. The method defined in claim 1 in which the rotary furnace is generally cylindrical with a closed end and an open end and with the axis of rotation inclined upwardly toward said open end, the open end being in the general form of a hollow truncated cone with the opening being formed at the truncated end, the burning gases being produced from a burner lance projecting into the open end of the furnace, the feed pipe from which the material is discharged also projecting into the furnace through said open end and having a terminal from which the material is discharged located to deposit the particulate material in the area proximate the base of said hollow truncated terminal cone portion of the furnace.

3. The method of melting finely divided material which comprises feeding it through a material feeding lance which is entered into the open end of a rotating furnace onto the furnace lining at a place in the furnace between said open end and that edge of a pool of molten material within the furnace which is nearest said open end and near the lowest point in that circle of rotation of the furnace lining onto which the material is delivered, firing the furnace while the feeding of the material continues with a lance entered into the same open end of the furnace as the material feeding lance at a level above the place where the finely divided material is discharged onto the hot furnace lining and at an angle where the flame generated by the burner is directed against the surface of said molten material inwardly toward the opposite end of the furnace from the place where the finely divided material is discharged onto the lining, the burner being operated to maintain the lining of the furnace above the melting point of the finely divided material and at a temperature to keep the pool of molten material in a liquid condition, rotating the furnace at a speed where centrifugal force holds the finely divided material against the furnace lining while said material is being melted, and collecting the melted material in said pool.

4. The method defined in claim 3 in which the centrifugal force keeps unmelted particles of the material from being carried away by burned gases leaving the furnace through said open end while also keeping the said unmelted material from being dislodged by gravity as it is carried around by the rotation of the rotary furnace.

5. The method defined in claim 3 in which the axis of rotation of the furnace is inclined upwardly toward the open forward end of the drum and the pool of molten metal is kept in the lower portion of the furnace, the pool decreasing in depth toward the upper end short of the place where the particulate material is deposited on the lining of the rotating furnace.

* * * * *